US011020877B2

(12) United States Patent
Soler Balcells

(10) Patent No.: US 11,020,877 B2
(45) Date of Patent: Jun. 1, 2021

(54) BASE FOR MANUAL CERAMIC CUTTERS

(71) Applicant: GERMANS BOADA, S.A., Rubi (ES)

(72) Inventor: Jordi Soler Balcells, Rubi (ES)

(73) Assignee: GERMANS BOADA, S.A., Rubi (ES)

( * ) Notice: Subject to any disclaimer, the term of this patent is extended or adjusted under 35 U.S.C. 154(b) by 254 days.

(21) Appl. No.: 15/559,724

(22) PCT Filed: Feb. 24, 2016

(86) PCT No.: PCT/ES2016/070118
§ 371 (c)(1),
(2) Date: Sep. 19, 2017

(87) PCT Pub. No.: WO2016/151164
PCT Pub. Date: Sep. 29, 2016

(65) Prior Publication Data

US 2018/0043575 A1 Feb. 15, 2018

(30) Foreign Application Priority Data

Mar. 20, 2015 (ES) ..... ES201500227

(51) Int. Cl.
*B28D 7/04* (2006.01)
*B28D 1/22* (2006.01)

(52) U.S. Cl.
CPC ..... *B28D 7/04* (2013.01); *B28D 1/225* (2013.01)

(58) Field of Classification Search
CPC .. B28D 7/04; B28D 7/043; A47B 3/02; A47B 1/00; A47B 1/04; B23D 47/02; B23D 47/025; B23D 57/0092
See application file for complete search history.

(56) References Cited

U.S. PATENT DOCUMENTS 4,195,889 A * 4/1980 Coyne ..... A47B 3/10 190/12 R
6,053,159 A 4/2000 Liu
6,148,810 A * 11/2000 Hepworth ..... B28D 1/225 125/23.01

(Continued)

FOREIGN PATENT DOCUMENTS

CA 2840412 A1 * 8/2014 ..... B28D 1/225
EP 2014431 A1 1/2009

(Continued)

OTHER PUBLICATIONS

International Search Report dated Apr. 8, 2016 of corresponding International application No. PCT/ES2016/070118; 4 pgs.

*Primary Examiner* — Tyrone V Hall, Jr.
*Assistant Examiner* — Joel D Crandall
(74) *Attorney, Agent, or Firm* — Maier & Maier, PLLC

(57) ABSTRACT

A base for manual ceramic cutters, which is provided with a support surface for the ceramic parts to be cut, the base including a rigid profile in the central longitudinal area, which rigid profile is secured to the supports of longitudinal displacement guides for a tool-holder head; and two lateral platforms mounted on the rigid profile by longitudinal shafts, which lateral platforms can be lowered between a horizontal use position, in which they form a support surface for the ceramic parts to be cut, and an inoperative position, in which the base defines a smaller surface area.

4 Claims, 4 Drawing Sheets

(56) References Cited

U.S. PATENT DOCUMENTS

| | | | | |
|---|---|---|---|---|
| 6,935,544 | B2 * | 8/2005 | Torrents I Comas .. | B28D 1/225<br>125/23.02 |
| 7,047,856 | B2 * | 5/2006 | Nurenberg ..... | B23D 45/024<br>83/471.3 |
| 2004/0031365 | A1 * | 2/2004 | Lee ..... | B28D 1/047<br>83/437.1 |
| 2005/0034783 | A1 * | 2/2005 | Laird ..... | B25H 1/04<br>144/286.5 |
| 2005/0241550 | A1 * | 11/2005 | Neunzert ..... | A47B 3/00<br>108/129 |
| 2012/0152155 | A1 * | 6/2012 | Healy ..... | B25H 1/04<br>108/50.11 |

FOREIGN PATENT DOCUMENTS

| | | | |
|---|---|---|---|
| ES | 1040704 | U | 5/1999 |
| ES | 2179777 | A1 | 1/2003 |
| ES | 1057335 | U | 7/2004 |

* cited by examiner

BASE FOR MANUAL CERAMIC CUTTERS

OBJECT OF THE INVENTION

The object of the present invention is a base for manual ceramic cutters that, comprising a support surface for ceramic parts to be cut, said support surface being under longitudinal displacement guides for a tool-holder head, has particular constructive characteristics intended to allow said base to fold in an inoperative position, reducing the space needed to collect and transport the cutter.

STATE OF THE ART

Currently, manual ceramic cutters having a base with a support surface for the ceramic parts to be cut and, supports on the ends of the base that support guides on which a toolhoder head is mounted and can be moved longitudinally, basically provided with a grip handle, a cutting tool for scoring the ceramic part positioned on the base and a separator for the ceramic part once scored, are known.

In these cutters, it is necessary that the support surface of the part to be cut is enough for it to be maintained in a stable position during the scoring and separation operations.

Some known cutters are those in which the support surface of the part is defined in the base itself, in addition to the cutters, for example, of the type described in the utility model ES 1040704 U of the same applicant, in which the support surface of the part is made up of lateral platforms that can be slightly moved in a vertical direction with respect to the base.

Independent of whether the support surface of the part to be cut is secured or formed by lateral platforms, the base has significant dimensions that supports the parts to be cut in a stable way, said base defining the minimum measurements of the area of the cutter and requiring the use of large cases to transport these cutters.

To increase the surface support of the ceramic parts to be cut in the aforementioned utility model ES 1040704 U, it is envisaged that the base of the cutter has foldable feet on the sides thereof, which can be attached to the sides of the base or unfolded toward the outside.

The applicant of the present invention is not aware of the existence of prior art of manual ceramic cutters that reduce the dimensions of the base and minimize the space needed to collect and transport the cutter.

DESCRIPTION OF THE INVENTION

The base for manual ceramic cutters object of the present invention has characteristics intended to satisfactorily solve the problem posed above, making it possible to minimize the dimension of the base area when the cutter is not operating and define a surface of suitable dimensions to provide a stable support for the ceramic parts when the cutter is in an operative position or in a position of use.

To do so, and according to the invention, the base of the cutter comprises a rigid profile in the central longitudinal area thereof, secured by the ends thereof to supports upon which the longitudinal displacement guides for a tool-holder head are secured on top; and two lateral platforms mounted on the rigid profile by means of longitudinal shafts and which can be lowered between a horizontal use position, in which they form a support surface for the ceramic parts to be cut, and a folded-out in which the base defines a smaller surface area.

In one embodiment of the invention, each lateral platform is formed by articulated plates by means of longitudinal rotary shafts.

The aforementioned lateral platforms have plastic terminations on a lateral end thereof, mounted and rotatable between a folded-out position and a folded position, and such that the position of use of the cutter increases the support surface of the parts to be cut.

The use of these articulated lateral platforms enables lowering towards an inoperative position, for example, towards the upper area, the displacement guides for a tool-holder head looping around the sides and thus significantly reducing the width of the cutter.

In one embodiment of the invention, the lateral terminations of the base have a reduced length and can be moved along the respective end plates of the lateral platforms, which allows them to be in the most suitable position for each case.

These and other characteristics of the invention will be better understood in view of the exemplary embodiment shown in the attached figures.

DESCRIPTION OF THE FIGURES

As a complement to the description provided herein, and for the purpose of helping to make the characteristics of the invention more readily understandable, the present specification is accompanied by a set of drawings, which, by way of illustration and not limitation, represent the following.

PREFERRED EMBODIMENT OF THE INVENTION

Figure 1:
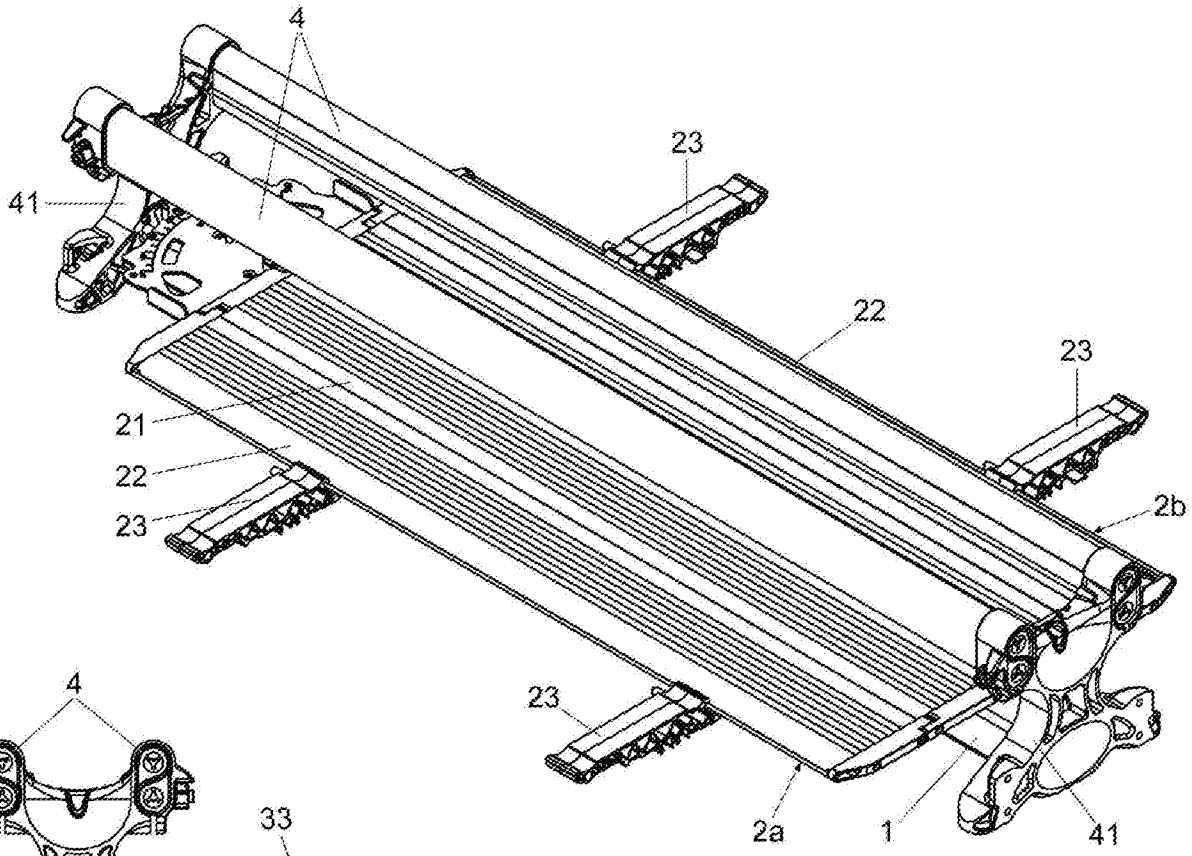
FIGS. 1 and 2 show perspective and profile views of an exemplary embodiment of the base for manual ceramic cutters according to the invention in a position of use, in other words, with the lateral platforms unfolded.
Figure 2:
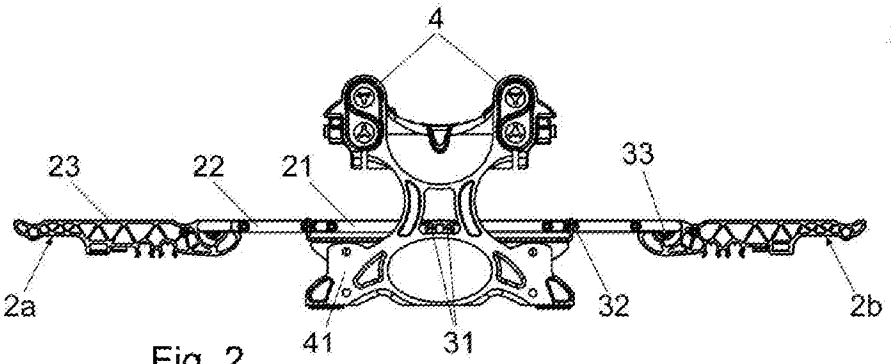
Figure 5:
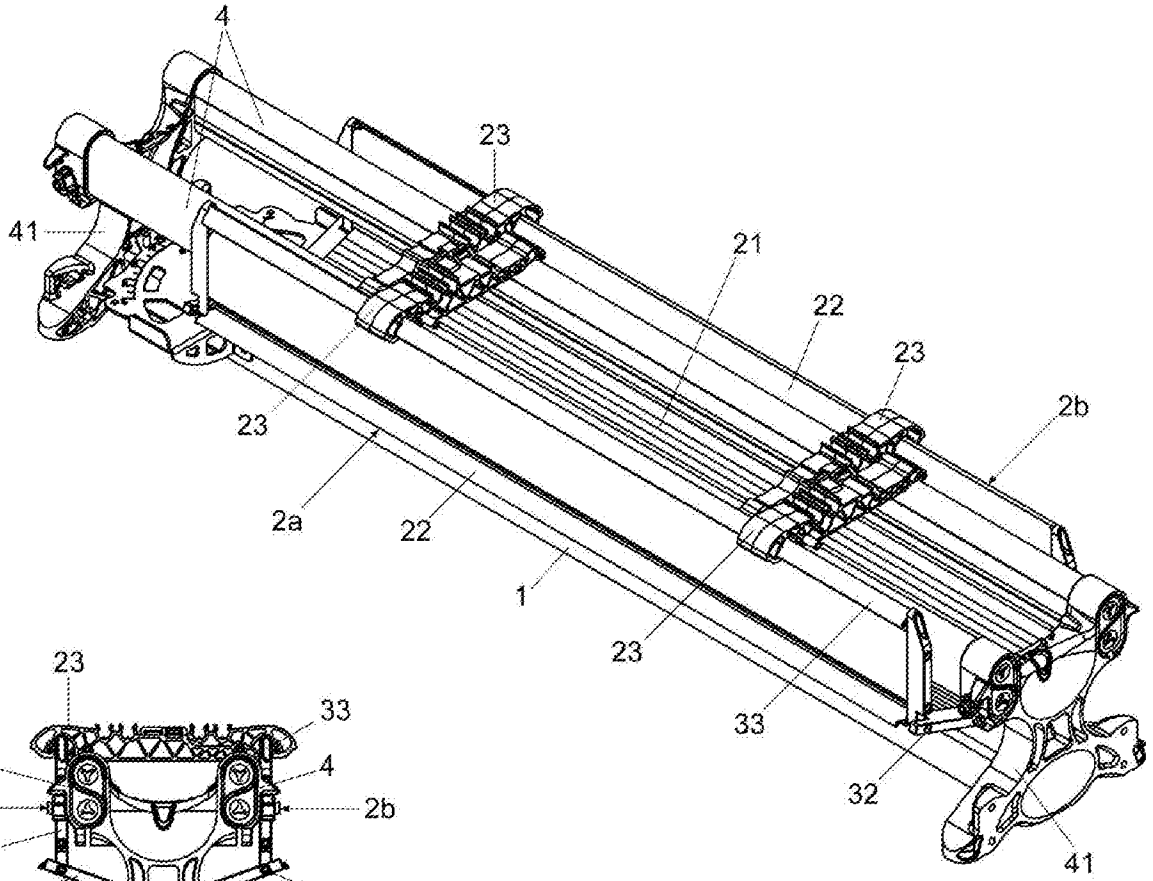
FIGS. 5 and 6 show perspective and profile views of the base for manual ceramic cutters with two lateral platforms folded in an inoperative position.
Figure 6:
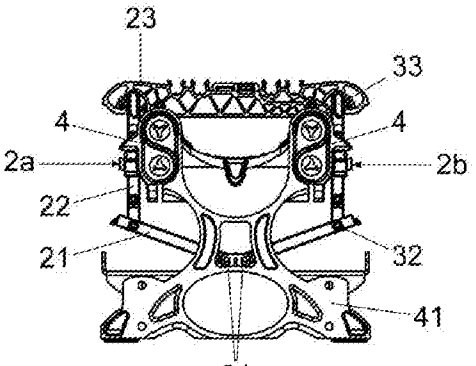

In the exemplary embodiment shown in FIGS. 1 and 2, the base for manual ceramic cutters comprises a rigid steel profile (1) in the central longitudinal area on which two lateral platforms (2*a*, 2*b*) are mounted by means of longitudinal shafts (31) that allow the lowering thereof between a horizontal use position shown in FIGS. 1 and 2 and an inoperative position shown in FIGS. 5 and 6.

In the example shown, each lateral platform (2*a*, 2*b*) is formed by a first plate (21), in this case made from aluminum, a second plate (22) articulated on the first plate by means of a rotary shaft (32) and terminations (23), in this case made from plastic, like lateral arms, which are mounted and can be rotated and longitudinally moved with respect to a rotary shaft (33) defined on the free end of the second plate (22) of the corresponding platform (2*a*, 2*b*).

Figure 3:
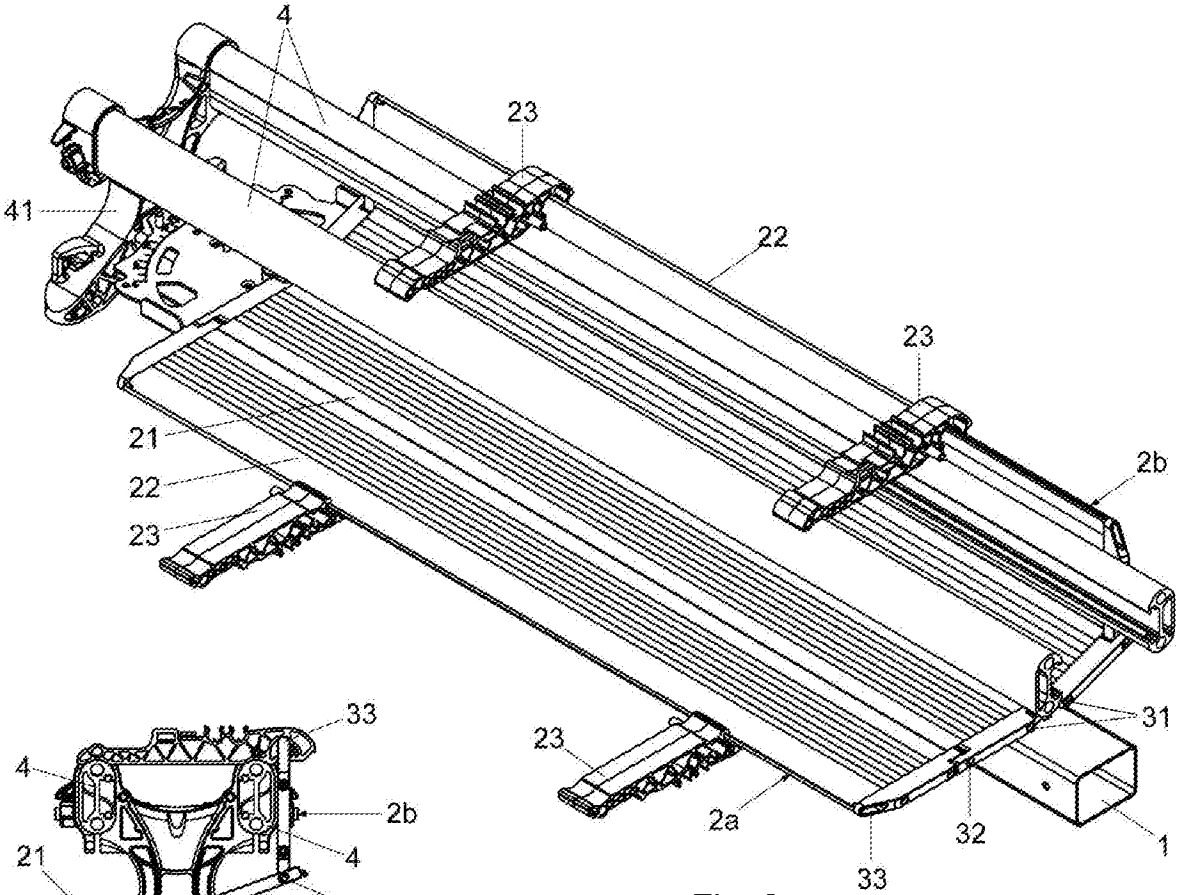
FIGS. 3 and 4 shows perspective and profile views of the base for manual ceramic cutters of the preceding figure in which one of the lateral supports of the guides has been removed to make it easier to observe the rigid profile in the central longitudinal area, and in which one platform folded in an inoperative position and another lateral platform unfolded in the position of use are shown.
Figure 4:
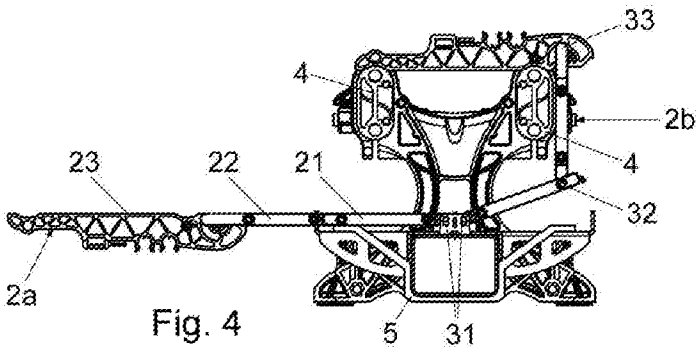

As already mentioned, these articulated lateral platforms (2*a*, 2*b*) can be unfolded in the position of use shown in FIGS. 1 and 2, or individually folded as shown in FIGS. 3 and 4 until they reach an entirely unoperative position, shown in FIGS. 5 and 6, in which said lateral platforms (2*a*, 2*b*) loop around the sides and top of the longitudinal displacement guides (4) of a tool-holder head, not shown because they are a common element in this type of cutter.

The rigid profile (1) of the base is secured by the ends thereof to the supports (41) of the guides (4), said supports (41) forming, in this case, support feet for the base of the cutter on any surface.

As can be seen in FIGS. 5 and 6, the folding of the platforms (2*a*, 2*b*) towards the inoperative position makes it possible to significantly reduce the total width of the cutter, making its storage and transport easier.

As can be seen in FIG. 4, it is provided that the base can incorporate springs (5) on the ends of the rigid profile (1) to provide certain cushioning to the lateral platforms (2*a*, 2*b*) when they are unfolded in the position of use of the cutter.

Figure 7:
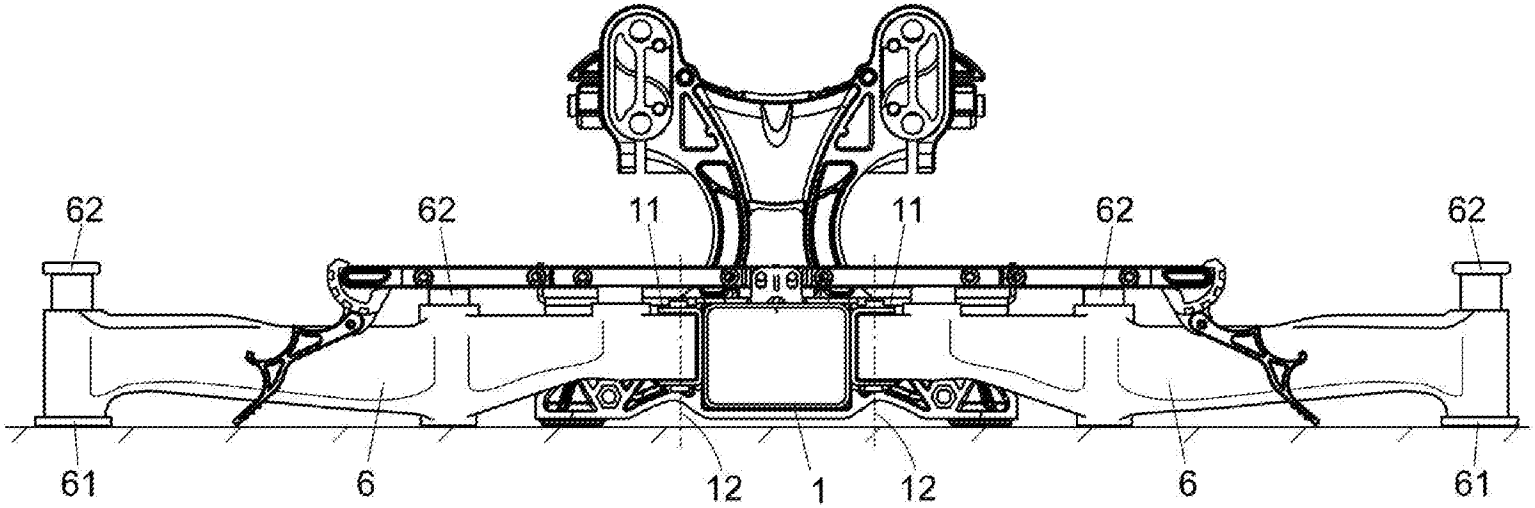
FIG. 7 shows a profile view of a variant embodiment of the manual ceramic cutter provided with folding arms to support the lateral platforms and stabilize the cutter in a position of use.

In the variant embodiment shown in FIG. 7, the cutter comprises folding arms (6) on the sides under the lateral platforms (2*a*, 2*b*), with a length greater than the width of said lateral platforms.

These folding arms (6) are mounted on the opposite sides of the rigid profile (1) by means of supports (11) and the corresponding rotary shafts (12), which allows them to be attached to the sides of the rigid profile (1) or unfolded in an essentially perpendicular direction to said rigid profile (1), as shown in FIG. 7.

Said folding arms (6) have: —internally, support feet (61) on the floor; and on the top, suspension elements (62) and support elements of the lateral platforms (2*a*, 2*b*) in an unfolded position.

In the unfolded position of use shown in FIG. 7, said folding arms (6) stabilize the cutter, preventing the swinging or sideways tipping thereof, especially when working with large ceramic parts.

In this case, the terminations (23) only serve to keep the lateral platforms in a folded position, similar to that shown in FIG. 5, since in the case of working with large ceramic parts, they are supported on lateral platforms and on suspension elements (62) closest to the free end of the folding arms (6) which remain outside the lateral platforms (2*a*, 2*b*).

Having sufficiently described the nature of the invention, in addition to an example of a preferred embodiment, it is hereby stated for the relevant purposes that the materials, shape, size and layout of the described elements may be modified, provided that it does not imply altering the essential characteristics of the invention claimed below.

The invention claimed is:

1. A manual ceramic cutter providing a support surface for ceramic parts to be cut, comprising:

longitudinal displacement guides for a tool-holder head;

supports supporting the longitudinal displacement guides;

a base comprising a rigid steel profile in a central longitudinal area of the ceramic cutter, the rigid steel profile being secured to the supports supporting the longitudinal displacement guides; and two lateral platforms are articulately mounted on the rigid steel profile by respective longitudinal rotary shafts located adjacent to each other at an upper central region of the rigid steel profile;

wherein the two lateral platforms can be lowered about the respective longitudinal rotary shafts between a horizontal use position, in which the two lateral platforms form the support surface for the ceramic parts to be cut, and an inoperative position in which the base defines a smaller surface area;

wherein each lateral platform comprises, at least, a first plate mounted on the rigid steel profile by the corresponding longitudinal rotary shaft, and a second plate articulated on the first plate by a first rotary shaft; and wherein each lateral platform comprises terminations on a lateral end thereof made from plastic, providing lateral arms, wherein the terminations are mounted and can be rotated and longitudinally moved with respect to a second rotary shaft defined on a free end of the second plate of the corresponding platform.

2. The manual ceramic cutter according to claim 1, wherein in the inoperative position, the lateral platforms loop around at least sides of the longitudinal guides.

3. The manual ceramic cutter according to claim 1, further comprising spring members on ends of the rigid steel profile to cushion the lateral platforms when the lateral platforms are unfolded in the position of use.

4. The manual ceramic cutter according to claim 1, further comprising side folding arms under the lateral platforms, mounted on opposite sides of the rigid steel profile, the side folding arms having a length greater than a width of said lateral platforms, and comprising internally, support feet on the floor; and on the top, suspension elements and support elements for the lateral platforms in an unfolded position.

* * * * *